US005174774A

United States Patent [19]

Le Bris et al.

[11] Patent Number: 5,174,774

[45] Date of Patent: Dec. 29, 1992

[54] LEVER LOCKED CONNECTOR

[75] Inventors: Henri Le Bris, Antony; Marie-Noëlle Bonnetier, Bagneux, both of France

[73] Assignee: Souriau & Cie, Versailles Cedex, France

[21] Appl. No.: 768,696

[22] PCT Filed: Feb. 20, 1991

[86] PCT No.: PCT/FR91/00138

§ 371 Date: Oct. 21, 1991

§ 102(e) Date: Oct. 21, 1991

[87] PCT Pub. No.: WO91/13476

PCT Pub. Date: Sep. 5, 1991

[30] Foreign Application Priority Data

Feb. 20, 1990 [FR] France ..... 90 02033

[51] Int. Cl.[5] ..... H01R 13/00

[52] U.S. Cl. ..... 439/160

[58] Field of Search ..... 439/152-160

[56] References Cited

U.S. PATENT DOCUMENTS

| | | | |
|---|---|---|---|
| 2,514,246 | 7/1950 | Knox | 439/160 |
| 3,054,023 | 9/1962 | Blecker et al. | 439/160 |
| 3,784,954 | 5/1971 | Grimm . | |
| 3,801,757 | 4/1974 | Carissimi et al. | 439/157 |
| 3,836,938 | 9/1974 | Barrett . | |

FOREIGN PATENT DOCUMENTS

| | | |
|---|---|---|
| 0360576 | 3/1990 | European Pat. Off. . |
| 2149589 | 6/1985 | United Kingdom . |

*Primary Examiner*—Joseph H. McGlynn

*Attorney, Agent, or Firm*—Larson and Taylor

[57] ABSTRACT

The invention relates to electrical connectors having a plug and a socket which can be coupled into each other by insertion and carrying cooperating contacts provided with locking means comprising a fork lever whose branches rotate on one of the elements (socket or, more frequently, plug) about an axis transversal to the plug-in direction and have claws engaging on a ramp provided on the other element (plug or, more frequently, socket) during the tilting of the lever about its axis in a direction bringing it onto the element which carries it.

4 Claims, 2 Drawing Sheets

LEVER LOCKED CONNECTOR

The invention relates to electrical connectors having a plug and a socket which can be coupled into each other by insertion and carrying cooperating contacts provided with locking means comprising a fork lever whose branches rotate on one of the elements (socket or, more frequently, plug) about an axis transversal to the plug-in direction and have claws engaging on a ramp provided on the other element (plug or, more frequently, socket) during the tilting of the lever about its axis in a direction bringing it onto the element which carries it.

In numerous cases, electrical connectors have to be placed at locations where they are difficult to access and where in particular it is difficult to exert by hand a force for inserting or pulling out the plug. This situation is encountered especially in the motor vehicle industry and it is possible to mention by way of example gearbox output connectors.

Connectors of the type defined hereinabove have already been proposed in which the tilting of the lever, relatively easy to effect by gripping the plug-lever assembly in the hand, completes the insertion of the plug and locks it. But these connectors only solve the problem very partially, as the extraction must also be performed by pulling on the plug, after rotation of the lever in order to unlock it. Moreover, many of the existing connectors of the type defined hereinabove are liable to become loose under the effect of axial or transverse vibrations.

The invention aims to provide a connector of the type defined hereinabove in which an action on a lever enables not only locking and unlocking to be effected but also the insertion and the extraction of the plug and which, in addition, guarantees a complete plug-in retention even in the case of intense vibrations.

With this aim in mind, the invention proposes in particular a connector of the type defined hereinabove in which, in addition to the locking claw intended to bear on the ramp, oriented in such a manner that the tilting of the lever causes the plug and the socket to come closer to each other, each branch of the fork comprises an additional finger intended to bear on a ramp oriented in the direction opposite to the first ramp and having a profile such that movement of the lever from its locking position exerts a force tending to separate the plug from the socket.

The invention will be better understood upon reading the description which follows of a particular embodiment given by way of non-limiting example. The description refers to drawings which accompany it, in which.

Figure 3:
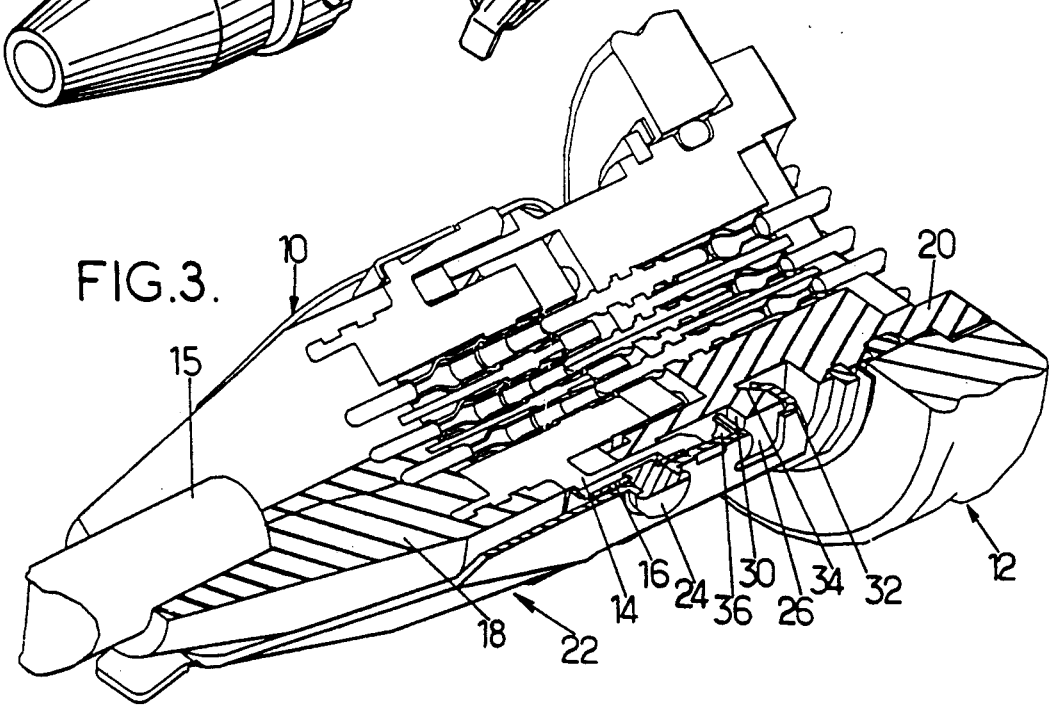
FIG. 3 is a view, in perspective and in partial cross section, of the connector in its state at the completion of locking.
Figure 4:
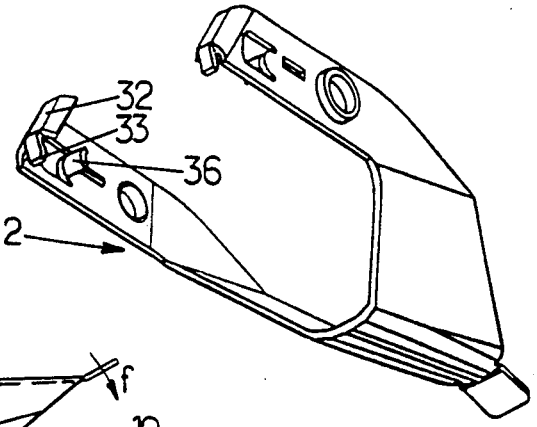
FIG. 4 is a view, in perspective, of the locking lever of the connector of FIGS. 1 to 4, intended to make the shape of the unlocking fingers appear clearer.
Figure 6:
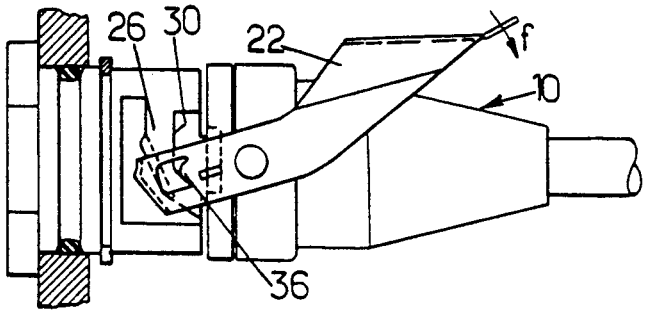

FIG. 6, similarly to FIG. 3, is a front view of the connector showing the elements in the position in which they are situated at the start of the extraction movement.

Figure 2:
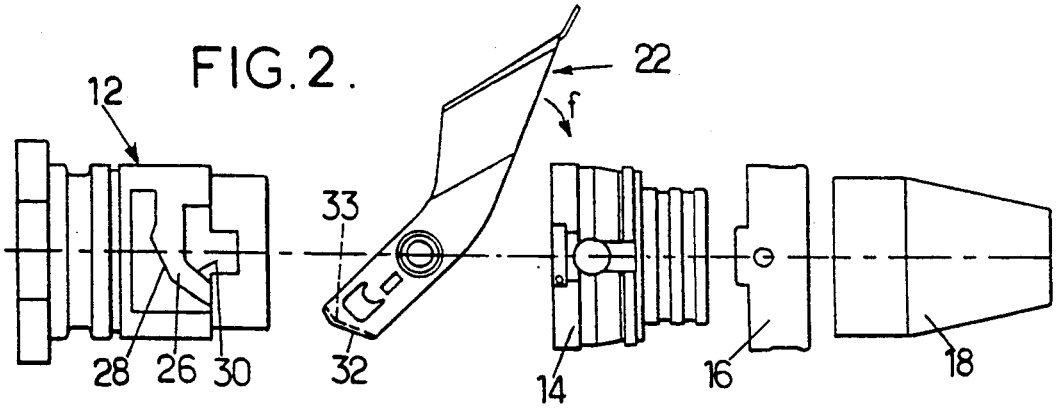
FIG. 2 is an exploded view, from the front, showing the components of the connector of FIG. 1, in a position opposite to that of FIG. 1.
Figure 1:
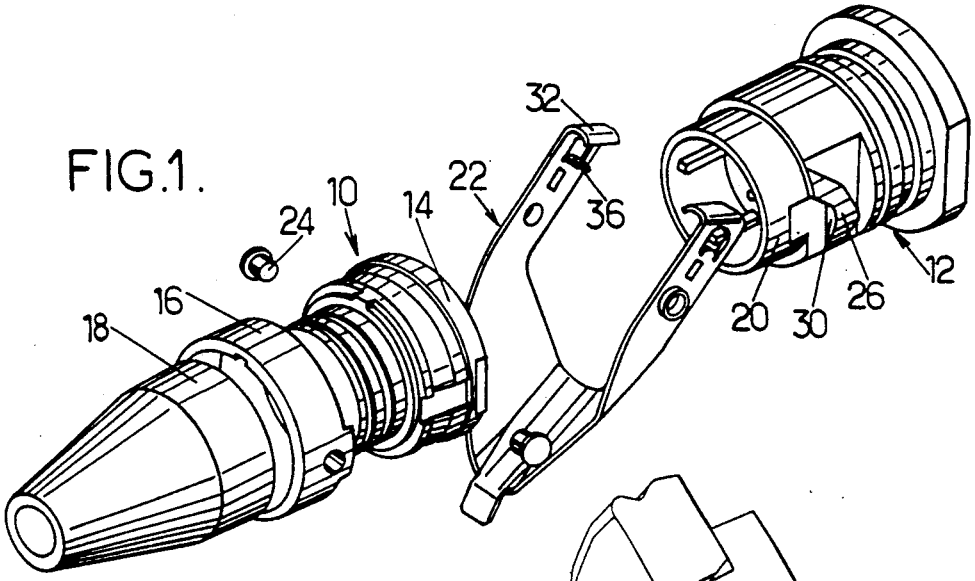
FIG. 1 is an exploded view, in perspective, showing the main components of an electrical connector of the type called "round" to which the invention relates.

The connector whose main components are shown in FIGS. 1 to 3 has a generally known construction. It is composed of a plug 10 and a socket 12. The plug has a sleeve 14 which contains or constitutes a rigid insulating block pierced through by passages for receiving electrical contact terminals. When the plug is mounted on an electrical cable 15 (FIG. 3), the conductors of the cable are connected to the terminals. An adaptor 18 is overmolded over the cable 15 and the sleeve 14. A retention ring 16 surrounds the front portion of the sleeve.

The socket 12 comprises a body 20 having a tubular front portion intended for engagement in the sleeve 14, containing or constituting an insulator for receiving contact terminals which can be engaged in those of the plug 12.

The cooperating locking and unlocking means which equip the plug 10 and the socket 12 comprise a fork lever 22 whose branches rotate, in the embodiment illustrated, on the plug 10 about an axis orthogonal to the axis of the plug. This axis is materialized by two pins 24 fastened onto the ring 16. In general, the axis for tilting the lever will be placed in a diametral plane of the connector, as illustrated in the Figures. The branches of the lever 22, which lever will generally be constituted from metal sheet which is cut out and bent, have claws 32 constituted by terminal portions of the branches, folded over towards the inside.

The locking means also comprise, on the body 20 of the socket, two elongate cams 26 which are symmetrical in relation to an axial plane of the socket defining a first ramp 28, directed towards the rear and being involved during the coupling and the locking, and a second ramp 30, directed towards the front, being involved during the extraction.

The terminal claws of the branches of the lever 22 are intended to bear against the first ramp 28 when the lever is tilted in the direction indicated by the arrow f, from the orientation in which it is shown in FIGS. 1 and 2. In the embodiment shown, each claw has, at the front in the tilting direction according to the direction f, a tab 33 constituted by a projecting tongue, which is relatively flexible. The internal edges of the claws are folded over towards the rear, in such a manner as to give these claws a generally J-shaped form. During coupling, the folded-over edges become engaged in grooves 34 provided at the base of the cams 26, prevent the opening of the fork and guide the claws 32.

Each ramp comprises at least one coupling zone and one locking zone, having slopes of inverse direction. In the embodiment shown, each ramp 28 has an entrance zone, defining a plane making an angle of approximately 60° with a diametral plane. The position of this plane and its orientation are chosen as a function of the position of the axis of tilting of the lever 22. The inclination of the entrance zones is such that the force caused by a tilting moment applied to the lever in the direction of the arrow f inserts the plug 10 into the socket 12. A coupling zone, following the first, has a smaller slope and brings the plug and the socket into their full engagement position.

Figure 5:
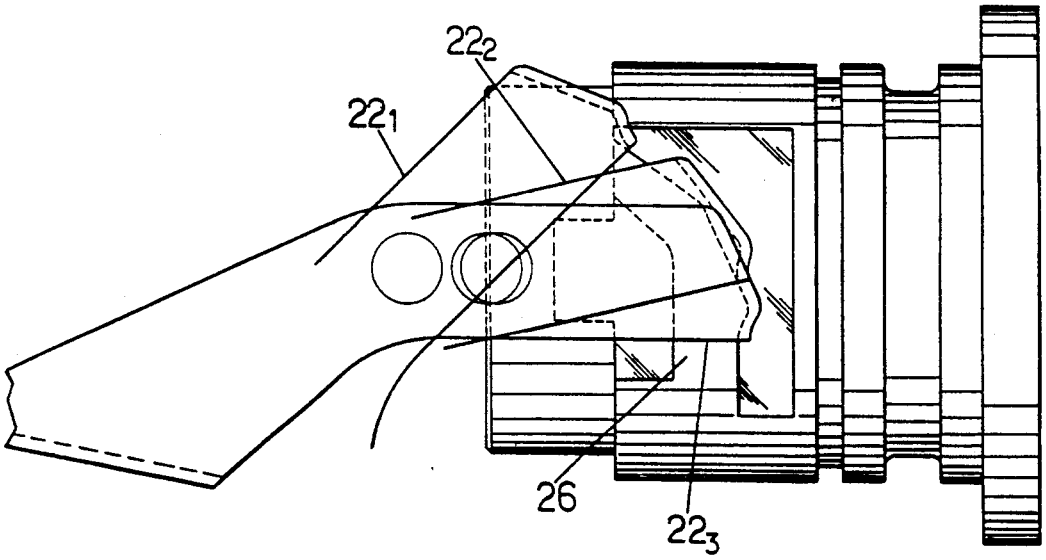
FIG. 5 is a diagram showing the successive relative positions of the lever and of the ramp during locking.

Finally, the locking in full engagement position is carried out, in the case shown by the passage of the tabs 33 beyond the second zones and by their bearing on a third zone, or locking zone, the slope of which is the reverse of that of the second zone and may be symmetrical with this slope. The joining edge between the second and third zones is placed in such a manner as to correspond to the coming to bear of the lever 32 against the plug 18, as is shown in FIG. 3. The positions. [sic]In FIG. 5, the numbers $22_1$, $22_2$ and $22_3$ denote successive positions of the lever 22 and the ramp 28. However, the lever is moved apart even more as indicated at 24 during the initial manual insertion. When the locking is achieved, the flexibility of the insulation or of a disk made of a flexible elastomer interposed between the rigid insulations prohibits any inadvertent unlocking.

The extraction ramps 30 cooperate with the fingers 36 constituted by cutting out tongues in the branches of the lever 22 and folding. The ramps 30 have a form such that the fingers 36 only bear on them when the lever 22 has rotated sufficiently in order to be unlocked. During the continuation of the tilting of the lever 22 in the direction opposite to the arrow f, each finger 36 bears on and slides over an oblique portion of the ramp 33 by exerting an extraction force. In the case illustrated in FIGS. 2 and 6, it is seen that the ramp 30 has a plane zone perpendicular to the axis of the connector, which is purely passive, and an oblique working zone which causes the extraction.

The invention is not limited to the particular embodiment which has been described by way of example. In particular, the claws and the fingers of the lever, as well as the ramps of one and the same cam, could be replaced by different elements fulfilling the same function. It should be understood that scope of the present patent extends to such alternative forms and, more generally, to all others residing in the framework of the equivalent forms.

We claim:

1. Electrical connector comprising:

a first element and a second element, one being a plug element and the other a socket element, arranged to be coupled upon longitudinal movement toward each other along a predetermined coupling direction;

cooperating electrical contacts carried by said first element and said second element, said contacts being arranged and distributed for the contacts of the first element to mate with the contacts of the second element upon coupling; and locking means having:

a forked lever formed with two branches which are pivotally connected onto said first element about an axis transverse to said coupling direction, each of said branches having an inwardly directed end claw and having an inwardly directed finger in an intermediate portion thereof; and a pair of cams formed on opposite sides of said second element, each said cam having a locking ramp turned away from the first element and shaped so that tilting of the forked lever in a first angular direction toward a locking position causes said claws to engage said locking ramps and to force said first element and said second element toward each other along said coupling direction for causing coupling, and each said cam having an extraction ramp facing the first element and arranged to receive one of said inwardly directed fingers, said extraction ramps having a shape such that movement of the lever from said locking position in a second angular direction opposite to said first angular direction causes said fingers to exert forces on the extraction ramps which tend to separate said first element and said second element.

2. Connector according to claim 1 characterized in that the lever is constituted from a folded metal sheet, in that the claws (32) are constituted by folded-over terminal portions of the branches and in that the fingers (36) are constituted by cut-out and folded-over portions of the branches.

3. Electrical connector comprising:

a first element and a second element, one being a plug element and the other a socket element, arranged to be coupled upon mutual longitudinal movement toward each other;

cooperating electrical contacts carried by said first element and said second element, said contacts being arranged and distributed for the contacts of the first element to mate with the contacts of the second element upon coupling; and locking means having:

a forked lever formed with two branches which are pivotally connected onto said first element about an axis transverse to the direction of said longitudinal movement, each of said branches having an inwardly directed end claw and having an inwardly directed finger; and a pair of cams formed on opposite sides of said second element, each said cam having a locking ramp shaped so that tilting of the forked lever in a first angular direction causes the claws to engage the locking ramps and to force the first element and second element toward each other along said coupling direction for causing coupling, and each said cam having a extraction ramp arranged to receive one of said inwardly directed fingers, said extraction ramps having a shape such that movement of the lever from a locking position in a second angular direction opposite to said first angular direction causes said fingers to exert forces on the extraction ramps which tend to separate the first element and second element, wherein each of said claws has a folded-over end edge, whereby each of said branches has a J-shape, and each of said cams has a guiding groove shape formed at a base of the respective locking ramp to receive a respective one of said folded-over end edges.

4. Electrical connector comprising a first element and a second element, one being a plug element and the other a socket element, arranged to be coupled upon movement toward each other along a predetermined coupling direction;

cooperating electrical contacts carried by said first element and said second element, said contacts being arranged and distributed for the contacts of the first element to mate with the contacts of the second element upon coupling; and locking means having:

a forked lever formed with two branches which are pivotally connected onto said first element about an axis transverse to said coupling direction, each of said branches having an inwardly directed end claw and having an inwardly directed finger; and a pair of cams formed on opposite sides of said second element, each said cam having a locking ramp shaped so that tilting of the forked lever in a first angular direction toward a locking position causes said claws to engage the locking ramps and to force said first element and said second element toward each other along said coupling direction for causing coupling, and each said cam having an extraction ramp arranged to receive one of said inwardly directed fingers, said extraction ramps having a shape such that movement of the lever from said locking position in a second angular direction opposite to said first angular direction causes said fingers to exert forces on the extraction ramps which tend to separate said first element and said second element;

wherein each of said locking ramps comprises an entrance zone, defining a plane making a predetermined angle with a diametral plane of said second element, a coupling zone having a smaller slope than the entrance zone and a locking zone having a slope reverse from those of the entrance zone; and wherein each of said claws has, in a front portion thereof in the first angular direction, an inwardly directed tab for mutually locking said first element and second element in coupled condition when said tab has moved beyond said coupling zone into said locking zone.

* * * * *